US011654687B2

(12) United States Patent
Smith

(10) Patent No.: US 11,654,687 B2
(45) Date of Patent: May 23, 2023

(54) ELECTRONIC DATA STORAGE DEVICE FOR USE WITH A CARTRIDGE FOR STORING AND DISPENSING LIQUID FOR USE WITH A PRINTER

(71) Applicant: Videojet Technologies Inc., Wood Dale, IL (US)

(72) Inventor: Robert Smith, Thrapston (GB)

( * ) Notice: Subject to any disclaimer, the term of this patent is extended or adjusted under 35 U.S.C. 154(b) by 0 days.

(21) Appl. No.: 17/373,292

(22) Filed: Jul. 12, 2021

(65) Prior Publication Data

US 2021/0339538 A1 Nov. 4, 2021

Related U.S. Application Data

(62) Division of application No. 16/300,324, filed as application No. PCT/GB2017/051241 on May 11, 2017, now Pat. No. 11,097,550.

(30) Foreign Application Priority Data

May 11, 2016 (GB) ..... 1608285

(51) Int. Cl.
*B41J 2/175* (2006.01)

(52) U.S. Cl.
CPC ..... *B41J 2/17546* (2013.01); *B41J 2/17513* (2013.01); *B41J 2/17543* (2013.01); *B41J 2/17553* (2013.01)

(58) Field of Classification Search
CPC ..... B41J 2/17546; B41J 2/17513; B41J 2/17543; B41J 2/17553; B41J 2/01; B41J 2/175; B41J 29/393; G06F 3/1279; G06F 3/1211; G06F 3/1219
See application file for complete search history.

(56) References Cited

U.S. PATENT DOCUMENTS

| | | | |
|---|---|---|---|
| 5,283,613 | A | 2/1994 | Midgley, Sr. |
| 5,699,091 | A | 12/1997 | Bullock et al. |
| 5,860,363 | A | 1/1999 | Childers et al. |
| 6,126,265 | A | 2/2000 | Childers et al. |
| 6,155,664 | A | 12/2000 | Cook |
| 6,454,381 | B1 | 9/2002 | Olsen et al. |
| 6,565,198 | B2 | 5/2003 | Saruta et al. |
| 6,938,976 | B2 | 9/2005 | Siwinski et al. |

(Continued)

FOREIGN PATENT DOCUMENTS

| | | | |
|---|---|---|---|
| AU | 712509 | B2 | 11/1999 |
| CN | 1192550 | A | 9/1998 |

(Continued)

OTHER PUBLICATIONS

PCT/GB2017/051241 International Search Report and Written Opinion, dated Oct. 25, 2017, 21 pages.

(Continued)

*Primary Examiner* — Bradley W Thies
(74) *Attorney, Agent, or Firm* — Wolter Van Dyke Davis, PLLC; Robert L. Wolter

(57) ABSTRACT

An electronic data storage device for use with a cartridge for storing and dispending liquid for use with an inkjet printer, the electronic data storage device storing printing data, wherein the printing data comprises at least one of: liquid density data, liquid conductivity data, recirculation data, and printer geometry data.

18 Claims, 6 Drawing Sheets

(56) References Cited

U.S. PATENT DOCUMENTS

| | | | |
|---|---|---|---|
| 8,579,396 | B2 | 11/2013 | Frazier et al. |
| 8,602,536 | B1 | 12/2013 | Sarnoff et al. |
| 2002/0135623 | A1 | 9/2002 | Tsukada et al. |
| 2002/0163562 | A1 | 11/2002 | Tanaka et al. |
| 2003/0035017 | A1 | 2/2003 | Helterline et al. |
| 2003/0206220 | A1 | 11/2003 | Childers et al. |
| 2004/0135857 | A1 | 7/2004 | Hashii et al. |
| 2004/0212651 | A1 | 10/2004 | Johnson et al. |
| 2007/0076067 | A1 | 4/2007 | Hamano et al. |
| 2009/0027439 | A1 | 1/2009 | Bauman |
| 2011/0193901 | A1 | 8/2011 | Martinez et al. |
| 2012/0026546 | A1* | 2/2012 | Miura ..... B41J 2/17509 358/1.15 |
| 2014/0339720 | A1 | 11/2014 | Menchik et al. |

FOREIGN PATENT DOCUMENTS

| | | | |
|---|---|---|---|
| CN | 1526565 | A | 9/2004 |
| CN | 1624603 | A | 6/2005 |
| CN | 101329737 | A | 12/2008 |
| CN | 104772981 | A | 7/2015 |
| EP | 0421806 | A2 | 4/1991 |
| EP | 0854045 | A2 | 7/1998 |
| EP | 0960736 | A1 | 12/1999 |
| EP | 1285764 | A1 | 2/2003 |
| EP | 2168773 | A1 | 3/2010 |
| EP | 2305470 | A1 | 4/2011 |
| EP | 2209636 | B1 | 7/2013 |
| GB | 2354735 | A | 4/2001 |
| GB | 2508881 | A | 6/2014 |
| JP | 09314861 | A | 12/1997 |
| WO | 199728001 | A1 | 8/1997 |
| WO | 2009145773 | A1 | 12/2009 |
| WO | 2009145774 | A1 | 12/2009 |
| WO | 2012066360 | A1 | 5/2012 |

OTHER PUBLICATIONS

Search Report for GB1608285.1, dated Nov. 14, 2016, 5 pages.
Search Report for GB1608285.1, dated May 2, 2017, 3 pages.
EPO Examination Report for EP17723473.9, dated Dec. 4, 2020, 5 pages.

* cited by examiner

ELECTRONIC DATA STORAGE DEVICE FOR USE WITH A CARTRIDGE FOR STORING AND DISPENSING LIQUID FOR USE WITH A PRINTER

The present invention relates to ink jet printing and more particularly, but not exclusively, to an electronic data storage device for use with a removable cartridge for an ink jet printer such as a continuous ink jet printer.

In ink jet printing systems the print is made up of individual droplets of ink generated at a nozzle and propelled towards a substrate. There are two principal systems: drop on demand where ink droplets for printing are generated as and when required; and continuous ink jet printing in which droplets are continuously produced and only selected ones are directed towards the substrate, the others being recirculated to an ink supply.

Continuous ink jet printers supply pressurised ink to a print head drop generator where a continuous stream of ink emanating from a nozzle is broken up into individual regular drops by, for example, an oscillating piezoelectric element. The drops are directed past a charge electrode where they are selectively and separately given a predetermined charge before passing through a transverse electric field provided across a pair of deflection plates. Each charged drop is deflected by the field by an amount that is dependent on its charge magnitude before impinging on the substrate whereas the uncharged drops proceed without deflection and are collected at a gutter from where they are recirculated to the ink supply for reuse. The charged drops bypass the gutter and hit the substrate at a position determined by the charge on the drop and the position of the substrate relative to the print head. Typically the substrate is moved relative to the print head in one direction and the drops are deflected in a direction generally perpendicular thereto, although the deflection plates may be oriented at an inclination to the perpendicular to compensate for the speed of the substrate (the movement of the substrate relative to the print head between drops arriving means that a line of drops would otherwise not quite extend perpendicularly to the direction of movement of the substrate).

In continuous ink jet printing a character is printed from a matrix comprising a regular array of potential drop positions. Each matrix comprises a plurality of columns (strokes), each being defined by a line comprising a plurality of potential drop positions (e.g. seven) determined by the charge applied to the drops. Thus each usable drop is charged according to its intended position in the stroke. If a particular drop is not to be used then the drop is not charged and it is captured at the gutter for recirculation. This cycle repeats for all strokes in a matrix and then starts again for the next character matrix.

Ink is delivered under pressure to the print head by an ink supply system that is generally housed within a sealed compartment of a cabinet that includes a separate compartment for control circuitry and a user interface panel. The system includes a main pump that draws the ink from a reservoir or tank via a filter and delivers it under pressure to the print head. As ink is consumed the reservoir is refilled as necessary from a replaceable ink cartridge that is releasably connected to the reservoir by a supply conduit. The ink is fed from the reservoir via a flexible delivery conduit to the print head. The unused ink drops captured by the gutter are recirculated to the reservoir via a return conduit by a pump. The flow of ink in each of the conduits is generally controlled by solenoid valves and/or other like components.

As the ink circulates through the system, there is a tendency for it to thicken as a result of solvent evaporation, particularly in relation to the recirculated ink that has been exposed to air in its passage between the nozzle and the gutter. In order to compensate for this, "make-up" solvent is added to the ink as required from a replaceable ink cartridge so as to maintain the ink viscosity within desired limits. This solvent may also be used for flushing components of the print head, such as the nozzle and the gutter, in a cleaning cycle.

The ink and solvent cartridges are filled with a predetermined quantity of fluid and generally releasably connected to the reservoir of the ink supply system so that the reservoir can be intermittently topped-up by drawing ink and/or solvent from the cartridges as required. To ensure the cartridges are brought into correct registration with supply conduits, the cartridges are typically connected to the ink supply system via a docking station comprising a cartridge holder. When the cartridges are correctly docked fluid communication with an outlet port of the cartridge is ensured.

It is important from the manufacturer's perspective that the ink jet printer is consumes only ink (or solvent) of the correct type and quality. If a cartridge containing the wrong ink is used the printing quality can be compromised and, in extreme cases, printer failure may be caused. It is therefore known, in some inkjet printers, to provide the cartridge with an externally machine readable label (e.g. a bar code) carrying information regarding the fluid contained within the cartridge. The label is swiped past a reader associated with the control system of the printer before the cartridge is installed and only when the control system of the printer has read the information on the label and verified that the ink is suitable for operation with the printer does it allow ink or solvent to be drawn from the cartridge.

It is an object of the present invention, amongst others, to provide an improved or an alternative ink jet printer.

According to a first aspect of the present invention there is provided an electronic data storage device for use with a cartridge for storing and dispending liquid for use with an inkjet printer, the electronic data storage device storing printing data, wherein the printing data comprises at least one of: liquid viscosity data, liquid density data, liquid conductivity data, cartridge geometry data, and printer geometry data.

By providing printing data relating to various properties of the ink contained within the cartridge or printer/cartridge geometry data on an electronic storage device associated with the cartridge it is possible to provide enhanced printing performance. Such an approach avoids any risk associated with manual entry of data which is inherently unreliable, and is susceptible to user error. Thus, by providing printing data in a memory location of an electronic data storage device associated with a cartridge, it can be ensured that this data is reliably available to the printer in use, allowing optimal control of the printer based upon the accurate printing data.

The liquid viscosity data may comprise data indicative of the viscosity of a liquid stored within the cartridge. The liquid density data may comprise data indicative of the density of a liquid stored within the cartridge. The liquid conductivity data may comprise data indicative of the conductivity of a liquid stored within the cartridge. The cartridge geometry data may comprise data indicative of the geometry of the cartridge. The data indicative of the geometry of the cartridge may comprise the data indicative of the volume of the reservoir of the cartridge. The printer geometry data may comprise data indicative of the geometry of one or more components of the printer which are suitable for use with the cartridge, and/or the liquid contained within the cartridge.

The printer geometry data may comprise data indicative of a diameter of a nozzle of the printer with which liquid contained within the cartridge is intended to be used. That is, the printer geometry data may comprise data indicative of suitable nozzle geometry.

The printing data may comprise recirculation data. The recirculation data may comprise data for controlling the recirculation of air to a printhead of the printer in a manner which is appropriate for the liquid contained within the cartridge. The recirculation data may comprise data indicative of a default level for controlling the recirculation of air to the printhead. The recirculation data may comprise a humidity threshold value. The humidity threshold value may comprise data indicative of a humidity level above which air recirculation to the printhead should be restricted for the type of ink contained within the cartridge. The recirculation data may comprise a temperature threshold value. The temperature threshold value may comprise data indicative of a temperature level above which air recirculation to the printhead should be restricted for the type of ink contained within the cartridge.

The electronic data storage device may be configured to permit data write access to a predetermined data storage portion only by an authorised device.

By allowing write access only by an authorised device printing performance can be improved by preventing data being altered by non-authorised devices, and ensure that the data is an accurate reflection of the current state of the consumable component (e.g. cartridge or filter module) associated with the electronic data storage device. For example, data items which indicate that a cartridge is empty can be prevented from being over-written by a non-authorised device, such that even if a cartridge is refilled (e.g. with ink which is not certified for use with a particular printer, or which is not the same as ink previously used with that printer) a cartridge can be prevented from being used with that printer, preventing contamination of the printer with incompatible ink.

The electronic data storage device may be configured to: receive a write request, the write request including address data associated with the predetermined data storage portion, and an identifier of a writing device;

authenticate the writing device based upon said identifier; and write data to said predetermined data storage portion if but only if said authentication indicates that said writing device is an authorised device.

There is also provided a cartridge for storing and dispending liquid for use with an inkjet printer, the cartridge comprising: a reservoir defining an internal space for storage of the liquid; an outlet for dispensing the liquid; and an electronic data storage device according to the first aspect of the invention.

There is also provided an ink jet printer comprising a cartridge having an electronic data storage device according to the first aspect of the invention. The ink jet printer may comprise a controller. The controller may be configured to receive data from said electronic data storage device, and control an operation of the printer based upon said received data.

Controlling an operation of the printer based upon said received data may further comprise receiving sensor data, and controlling said operation of the printer based upon said sensor data. That is, the printer may be controlled based upon both said sensor data and said received data.

Such control allows the printer to be controlled based upon sensor data (e.g. temperature and/or humidity sensor data) in a manner which is appropriate for the liquid contained within the cartridge (for example based upon threshold data stored in the electronic storage device which indicates appropriate humidity and/or temperature levels for that liquid).

The ink jet printer may be a continuous inkjet printer. The ink jet printer may be an authorised device.

According to a second aspect of the invention there is provided an ink jet printer comprising a controller. The printer is configured to receive a removable module comprising an electronic data storage device storing data related to an operation of the removable module, and at least one component selected from the group consisting of: a filter, a fluid damper, a valve, a pump, a gas sensor, a drop generator, an ink jet print nozzle, a piezoelectric oscillator, a charge electrode, a deflection electrode and a gutter. The printer is further configured to receive at least one cartridge. The controller is configured to receive data from said electronic data storage device, and control an operation of the printer based upon said received data.

A removable module is intended to mean a consumable component of the printer having one or more components which performs a mechanical function, and may be susceptible to wear. A removable module may be required to be replaced or serviced in a printer at a regular service interval. A cartridge (e.g. an ink cartridge or a solvent cartridge) is not considered to be a removable module of the printer. However, a cartridge is a consumable component of the printer.

The removable module may comprise a filter module, the component being a filter such as an ink filter.

The removable module may comprise a service module. The service module may comprise a pump such as, for example, a flush pump. The service module may comprise a valve such as, for example, a fluid control valve and/or a pressure relief valve. The service module may comprise a gas sensor.

The removable module may comprise a print module. The print module may be referred to as a printhead. The print module may comprise a drop generator comprising an ink jet print nozzle and a piezoelectric oscillator. The print module may comprise a charge electrode, and/or a deflection electrode, and/or a gutter.

The cartridge may be an ink cartridge. The cartridge may be a solvent cartridge. The cartridge may comprise a reservoir defining an internal space for storage of the liquid and an outlet for dispensing the liquid.

Data related to an operation of the removable module may comprise data relating to a condition of the removable module and/or a component of the removable module. Data relating to a condition of the removable module and/or a component of the removable module may comprise data indicative a number of hours for which the removable module and/or a component of the removable module has been used, or data indicating that the removable module and/or a component of the removable module has exceeded a predetermined usage limit.

The provision of a printer in which data is received, by a controller, from electronic storage devices associated with removable modules enables the printer to be automatically configured based upon the received data. For example, where removable modules are expected to have a service life which is less than that of the printer, or where they may be exchanged for any reason, the electronic data storage devices which are associated with those removable modules can allow automatic configuration changes to be made as required to ensure continued operation of the printer. In particular, where a parameter associated with a component may differ between a particular module and a replacement for that particular module (e.g. a filter lifetime or filter usage data) data relating to the parameter may be used to adjust the configuration of the printer in some way (e.g. to record usage and provide an appropriate alert). By providing the data to the controller of the printer it is possible to reduce the reliance of manual data entry (which is inherently unreliable) and to automatically reconfigure a printer as necessary.

The ink jet printer may be configured to receive a plurality of removable modules, the plurality of removable modules each comprising a respective electronic data storage device storing data related to an operation of the respective one of the plurality of removable modules, each of the plurality of removable modules further comprising a component selected from the group consisting of: a filter, a fluid damper, a valve, a pump, a gas sensor, a drop generator, an ink jet print nozzle, a piezoelectric oscillator, a charge electrode, a deflection electrode and a gutter.

By providing electronic data storage devices which are, respectively, associated with each of a respective plurality of removable modules it will be appreciated that the possibilities for automatic configuration are increased. This is especially the case where those modules may be provided in different varieties.

In particular, the use of automatic configuration in this way allows removable modules to be provided in different varieties without significantly increasing the risk of printer failure. That is, rather than providing a single variety of a modules which is suitable for all printers, and all uses, it may be desirable to provide a variety of modules, different ones of which may be particularly appropriate for a particular printer based upon properties such as, for example, expected rate of use, environmental conditions, maintenance requirements, and so on.

The controller may be configured to receive data from each of said electronic data storage devices, and control an operation of the printer based upon said received data.

Controlling an operation of the printer based upon said received data may comprise configuring an operation of the printer based upon said received data.

The at least one cartridge may also comprise an electronic storage device.

The controller may be configured to receive data from said electronic data storage device associated with the at least one cartridge, and control an operation of the printer based upon said received data.

Controlling an operation of the printer based upon said received data may further comprise receiving sensor data, and controlling said operation of the printer based upon said sensor data. That is, the printer may be controlled based upon both said sensor data and said received data.

The controller may be configured to receive data from a first electronic data storage device of the at least one cartridge and a second electronic data storage device of the removable module or one of the removable modules, and control an operation of the printer based upon said received data.

The use of data stored in electronic data storage devices associated with both cartridges and replaceable modules increases the number of ways in which automatic configuration and control of the printer can be provided. That is, rather than simply providing automatic configuration in relation to cartridge volume, this data can be used, in combination with usage data related to an ink pump contained within a service module of the ink supply system so as to ensure that appropriate maintenance operations are carried out at a convenient point in time. Alternatively, or additionally, compatibility can be checked between components, for example between a nozzle of a newly installed printhead with ink contained within an ink cartridge.

The electronic data storage device of the removable module or one of the removable modules, and/or the cartridge, may be configured to permit data write access to a predetermined data storage portion only by an authorised device. Said electronic data storage device may be configured to determine whether the controller is an authorised device and to permit data write access to the predetermined data storage address by the controller if but only if the controller is an authorised device.

The received data from said electronic data storage device storing data related to an operation of the removable module may comprise data indicative of a property of an ink jet print nozzle associated with a printhead of said printer. Controlling an operation of the printer based upon said received data may comprise generating a modulation signal for said ink jet print nozzle based upon said received data.

For example different nozzles may require different forms of modulation signal. Thus, by providing data indicating the particular type of nozzle, it is possible to control a printer based upon data stored within the electronic data storage device automatically, without having to manually reconfigure the printer when a nozzle type is changed (for example when a new printhead is installed).

According to a third aspect of the invention there is provided an ink jet printer configured to receive at least one consumable component, the at least one consumable component comprising: an electronic data storage device, the electronic data storage device being configured to store printing data, and being further configured to permit data write access to a predetermined data storage portion only by an authorised device; the ink jet printer comprising a controller; wherein the electronic data storage device is configured to: determine whether the controller is an authorised device and to permit data write access to the predetermined data storage address by the controller if but only if the controller is an authorised device.

By allowing write access only by an authorised device printing performance can be improved by preventing data being altered by non-authorised devices, and ensure that the data is an accurate reflection of the current state of a consumable component (e.g. cartridge or filter module) associated with the electronic data storage device. In this way, data items which indicate that a particular property of the cartridge are known to properly reflect that property. For example, data indicating that a cartridge is empty can be prevented from being over-written by a non-authorised device, such that even if a cartridge is refilled (e.g. with ink which is not certified for use with a particular printer, or which is not the same as ink previously used with that printer) a cartridge can be prevented from being used with that printer, preventing contamination of the printer with incompatible ink. In this way, printing performance can be protected and improved.

The electronic data storage device may be configured to: receive a write request, the write request including address data associated with the predetermined data storage portion, and an identifier of a writing device;

authenticate the writing device based upon said identifier; and write data to said predetermined data storage portion if but only if said authentication indicates that said writing device is an authorised device.

The predetermined data storage address may be arranged to store data relating to a condition of the consumable component.

Data relating to a condition data may comprise data indicative a number of hours for which the consumable component has been used, or data indicating that the consumable component has exceeded a predetermined usage limit.

The consumable component may comprise a cartridge for storing and dispending liquid for use with the inkjet printer, the cartridge comprising: a reservoir defining an internal space for storage of the liquid; an outlet for dispensing the liquid; and said electronic data storage device.

The condition data may comprise data indicating the volume of liquid remaining in the cartridge.

The consumable component may comprise a filter.

The condition data may comprise data indicating the number of hours for which the filter has been used.

It will be appreciated that features described in the context of one aspect of the invention may be used with another aspect of the invention. In particular, features described in the context of any of the first, second and third aspects of the invention may be used in combination with the other aspects of the invention, and features thereof.

Embodiments of the present invention will now be described, by way of example, with reference to the accompanying drawings, in which.

Figure 1:
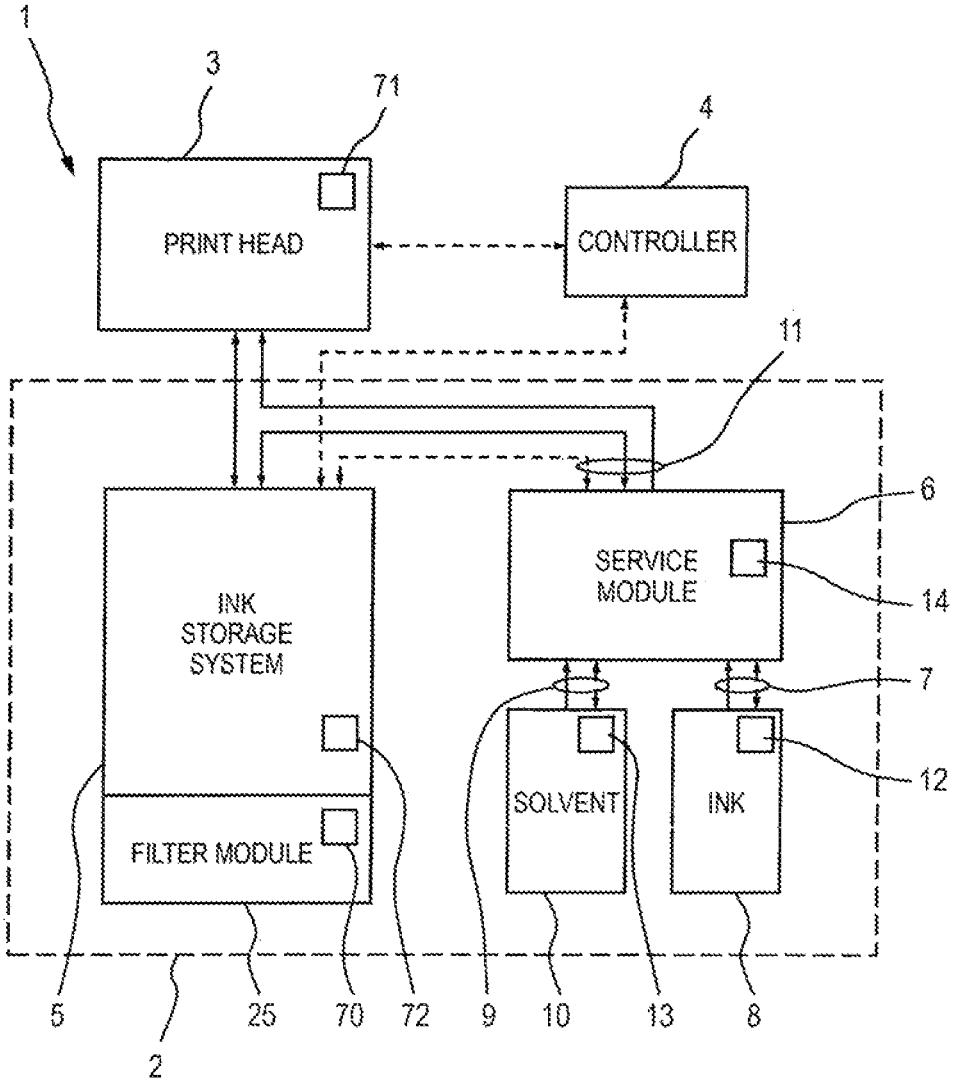
FIG. 1 is a schematic illustration of a continuous ink jet printer in accordance with an embodiment of the invention.

FIG. 1 schematically illustrates an inkjet printer 1. Inkjet printer 1 comprises an ink supply system 2, a print head 3 and a controller 4. The ink supply system 2 comprises an ink storage system 5 and a service module 6. In FIG. 1, fluid flow through the inkjet printer is illustrated schematically by solid arrows and control signals are illustrated schematically by dashed arrows. The service module 6 is configured for releasable engagement with inkjet printer 1 so that the module can be easily removed from the inkjet printer 1 for servicing or replacement. The service module 6 is therefore a removable module for an inkjet printer.

The service module 6 comprises two cartridge connections for releasable engagement with a fluid cartridge. In particular, the service module 6 comprises an ink cartridge connection 7 for releasable engagement with an ink cartridge 8 and a solvent cartridge connection 9 for releasable engagement with a solvent cartridge 10. The service module 6 further comprises a printer connection 11 for releasable engagement with an inkjet printer. In use, the service module 6 forms part of inkjet printer 1 and it will be appreciated that in this context in the expression "for releasable engagement with an inkjet printer" the term "inkjet printer" is intended to mean those parts of the inkjet printer excluding the service module 6.

The printer connection 11 comprises a plurality of fluid ports, each fluid port arranged to connect to a fluid pathway within the inkjet printer 1 to allow fluid to flow between the service module 6 and other parts of the inkjet printer 1, such as the ink storage system 5 and the print head 3. The printer connection 11 further comprises an electrical connector arranged to engage with a corresponding connector on the inkjet printer 1.

Each of the ink and solvent cartridge connections 7, 9 comprises a fluid connector for engaging an outlet of respective ink and solvent cartridges 8, 10 so as to allow fluid to flow from the cartridges 8, 10 into the service module 6. From the service module 6, ink and solvent can flow to the ink storage system 5 via the printer connection 11. In operation, ink from the ink cartridge 8 and solvent from the solvent cartridge 10 can be mixed within the ink storage system 5 so as to generate printing ink of a desired viscosity which is suitable for use in printing. This ink is supplied to the print head 3 and unused ink is returned from the print head 3 to the ink storage system 5. The service module 6 is also operable to provide a flow of solvent to the print head 3 via printer connection 11 for cleaning purposes.

The ink jet printer 1 is controlled by controller 4. Controller 4 receives signals from various sensors within the inkjet printer 1 and is operable to provide appropriate control signals to the ink supply system 2 and the print head 3 to control the flow of ink and solvent through the inkjet printer 1. The controller 4 may be any suitable device known in the art, and typically includes at least a processor and memory.

The ink cartridge 8 is provided with an electronic data storage device 12 storing data relating to the printer 1 and contained ink. Similarly, the solvent cartridge 10 is provided with an electronic data storage device 13 storing data relating to the printer 1 and contained solvent. The service module 6 may also comprise an electronic data storage device 14. The electronic data storage device 14 may store identification data (e.g. an identification code).

The ink storage system 5 also comprises a filter module 25 (which is described in more detail below), the filter module 25 being provided with an electronic data storage device 70. The print head 3 is also provided with an electronic data storage device 71. The ink storage system 5 itself is also provided with an electronic data storage device 72. The electronic storage device 72 may be provided, for example, on an ink management board (not shown). The controller 4 is arranged to communicate with the electronic data storage devices 12, 13, 14, 70, 71, 72 as described in more detail below.

The ink management board within the ink storage system 5 may, for example, be arranged to provide an interface between the controller 4 and each of the filter module 25 (and associated electronic storage device 70), service module 6 (and associated electronic storage device 14), the ink cartridge 8 (and associated electronic storage device 12) and the solvent cartridge 10 (and associated electronic storage device 13).

Figure 2:
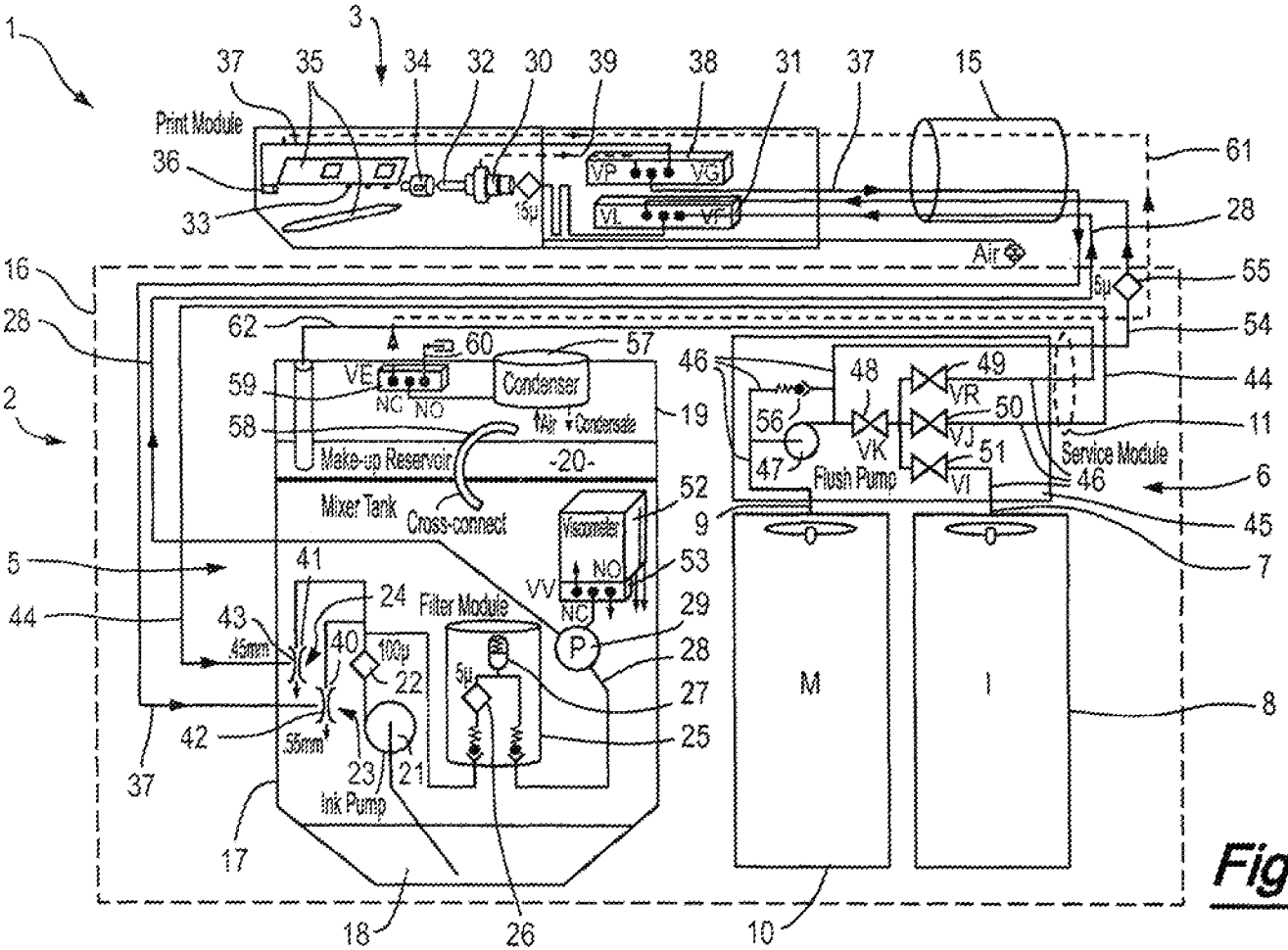
FIG. 2 is a schematic representation of the continuous ink jet printer of FIG. 1.

The ink jet printer 1, and particularly the ink supply system 2 is now described in further detail, with reference to FIG. 2. FIG. 2 schematically shows elements of the ink jet printer 1 of FIG. 1 in greater detail and, for clarity, the controller 4, the electronic data storage devices 12, 13, 14, 70, 71, 72 and associated signals have been omitted.

In operation, ink is delivered under pressure from ink supply system 2 to print head 3 and back via flexible tubes which are bundled together with other fluid tubes and electrical wires (not shown) into what is referred to in the art as an "umbilical" conduit 15. The ink supply system 2 is located in a cabinet 16 which is typically table mounted and the print head 3 is disposed outside of the cabinet 16.

The ink storage system 5 comprises a mixer tank 17 for storage of a reservoir of ink 18 and a solvent tank 19 for storage of a reservoir of solvent 20. The mixer tank has a generally tapered lower portion within which the reservoir of ink 18 is disposed.

In operation, ink is drawn from the reservoir of ink 18 in mixer tank 17 by a system pump 21. The mixer tank 17 is topped up as necessary with ink and make-up solvent from replaceable ink and solvent cartridges 8, 10. Ink and solvent are transferred from the ink and solvent cartridges 8, 10 to the mixer tank 17 via the service module 6 as will be described further below.

It will be understood from the description that follows that the ink supply system 2 and the print head 3 include a number of flow control valves which are of the same general type: a dual coil solenoid-operated two-way flow control valve. The operation of each of the valves is governed by the controller 4.

Ink drawn from the mixer tank 17 is filtered first by a first (relatively coarse) filter 22 downstream of the system pump 21 and then is delivered selectively under pressure to two venturi pumps 23, 24 and the filter module 25. Filter module 25 comprises a second, finer ink filter 26 and a fluid damper 27. Fluid damper 27 is of conventional configuration and removes pressure pulsations caused by the operation of the system pump 21. Ink is supplied through a feed line 28 to the print head 3 via a pressure transducer 29.

At the print head 3 the ink from the feed line 28 is supplied to a drop generator 30 via a first flow control valve 31. The drop generator 30 comprises a nozzle 32 from which the pressurised ink is discharged and a piezoelectric oscillator (not shown) which creates pressure perturbations in the ink flow at a predetermined frequency and amplitude so as break up the ink stream into drops 33 of a regular size and spacing. The break up point is downstream of the nozzle 32 and generally coincides with a charge electrode 34 where a predetermined charge is applied to each drop 33. This charge determines the degree of deflection of the drop 33 as it passes a pair of deflection plates 35 between which a substantially constant electric field is maintained. Uncharged drops pass substantially undeflected to a gutter 36 from where they are recycled to the ink supply system 2 through return line 37 via a second flow control valve 38. Charged drops are projected towards a substrate (not shown) that moves past the print head 3. The position at which each drop 33 impinges on the substrate is determined by the amount of deflection of the drop and the speed of movement of the substrate.

In order to ensure effective operation of the drop generator 30 the temperature of the ink entering the print head 3 may be maintained at a desired level by a heater (not shown) before it passes to the first control valve 31. In instances where the printer is started up from rest it is desirable to allow ink to bleed through the nozzle 32 without being projected toward the gutter 36 or substrate. In such instances ink flows from the first control valve 31 to the nozzle 32 and then returns to the second control valve 38 via a bleed line 39, where it joins return line 37. The passage of the ink into the return line 37, whether it is the bleed flow or recycled unused ink captured by the gutter 36, is controlled by the second flow control valve 38. The returning ink is drawn back to the mixer tank 17 by venturi pump 23.

Venturi pumps 23, 24 are of known configuration and make use of the Bernoulli Principle whereby fluid flowing through a restriction in a conduit increases to a high velocity jet at the restriction and creates a low pressure area. If a side port is provided at the restriction this low pressure can be used to draw in and entrain a second fluid in a conduit connected to the side port. In this instance, the pressurised ink flows through a pair of conduits 40, 41 and back to the reservoir 18 in the mixer tank 17. Each conduit 40, 41 is provided with a side port 42, 43 at the venturi restriction. The increase in flow velocity of the ink creates a suction pressure at the side port 42, 43 and this serves to draw returning ink and/or solvent through return line 37 and a supply line 44 respectively.

As ink flows through the system and comes into contact with air in the mixer tank 17 and at the print head 3, a portion of its solvent content tends to evaporate. The ink supply system 2 is therefore operable to supply make-up solvent as required so as to maintain the viscosity of the ink within a predefined range suitable for use.

The service module 6 comprises a body 45 defining a plurality of fluid conduits (shown schematically in FIG. 2 as lines 46). The service module 6 further comprises a flush pump 47 and four valves 48, 49, 50, 51 which are arranged to selectively link two or more of the plurality of fluid conduits 46 so as to form one or more fluid pathways through the body 45. The flush pump 47 and the valves 48, 49, 50, 51 are controlled by the controller 4 by sending one or more control signals via the printer connection 11. Using appropriate control signals, the service module 6 can be disposed in a plurality of different configurations to allow ink or solvent to flow through the inkjet printer 1 in a plurality of different modes, as now described. In the following, it should be assumed that each of the four valves 48, 49, 50, 51 is closed unless stated otherwise.

In operation, ink from the ink cartridge 8 and solvent from the solvent cartridge 10 can be added to the mixer tank 17 as required so as to generate printing ink of a desired viscosity which is suitable for printing. This addition of ink and/or solvent to the mixer tank 17 uses venturi pump 24.

Mixer tank 17 is provided with a level sensor (not shown) that is operable to determine a level of ink in the mixer tank 17 and output a signal indicative thereof to controller 4. Ink is consumed during printing and therefore during normal operation the level of ink in the mixer tank 17 will fall over time. When the level of ink in the mixer tank falls below a lower threshold the controller 4 is operable to control the ink supply system 2 so as to add more ink to the mixer tank 17. Using suitable control signals, ink is drawn from the mixer tank 17 by system pump 21 and delivered under pressure to venturi pump 24 to create suction pressure at the side port 43. In order to add ink to the mixer tank 17, valves 50, 51 in the service module 6 are opened. Ink is drawn from ink cartridge 8 along supply line 44 under suction pressure from venturi pump 24. The ink discharges into the mixer tank 17, increasing the level. When the level of ink in the mixer tank 17 reaches an upper threshold the controller 4 is operable to stop the supply of ink to mixer tank 17. To achieve this, flow to venturi pump 24 is stopped and valves 50, 51 are closed.

Following such a process of topping up the level of ink in mixer tank 17, the controller 4 sends a signal to data storage device 12 on ink cartridge 8 indicative of the quantity of ink that has been transferred from the cartridge 8 to the mixer tank 17. A quantity of ink remaining in the ink cartridge 8 may be stored on the data storage device 12 and may be updated in response to the signal from the controller 4.

As explained above, as ink flows through the system and comes into contact with air in the mixer tank 17 and that the print head 3, a portion of its solvent content tends to evaporate. Periodically, the viscosity of the ink within the mixer tank 17 (or a quantity indicative thereof) is determined using a viscometer 52 disposed in mixer tank 17.

The viscometer 52 is periodically supplied with ink under pressure from system pump 21 via filter module 25. Flow of ink into the viscometer is controlled by control valve 53. Using control valve 53, a predetermined volume of ink is supplied to a chamber within viscometer 52 and then supply of ink to the viscometer is stopped. Ink then drains out of the chamber under gravity. The rate at which the ink drains out of the chamber is dependent on the viscosity of the ink and is monitored using a plurality of electrodes disposed at different levels within the chamber. Signals from the plurality of electrodes are received by controller 4, which is operable to determine whether or not the viscosity of ink within the mixer tank 17 is within a desired operating range, defined by lower and upper threshold values.

If the viscosity is above the upper threshold value then solvent is added to the mixer tank 17 from solvent reservoir 20 in solvent tank 19 as now described. Ink is drawn from the mixer tank 17 and delivered under pressure to venturi pump 24 to create suction pressure at the side port 43. In order to add solvent, valves 49, 50 in the service module 6 are opened. Under suction pressure from the venturi pump 24, solvent is drawn from solvent reservoir 20 along line 62 to the service module 6 and back along supply line 44 to the mixer tank 17. The solvent discharges into the mixer tank 17, reducing the viscosity of the ink in reservoir 18.

The controller 4 may determine a quantity of solvent to add to the mixer tank 17 based on the determined viscosity of the ink. When a desired quantity of solvent has been added to the mixer tank 17, flow to the venturi pump 24 may be stopped and the valves 49, 50 are closed.

Once solvent has been added to the mixer tank 17, the viscometer 52 may be used again to determine the viscosity of ink. There may be a time delay between adding the solvent and re-checking the viscosity of the ink so as to allow the solvent to mix with ink. If upon re-checking the viscosity of the ink in mixer tank 17 the viscosity is still above the upper threshold value then more solvent may be added to the mixer tank 17 from solvent reservoir 20 in solvent tank 19. This process may be repeated until a desired viscosity of ink in mixer tank 17 is reached.

Solvent tank 19 is provided with a level sensor (not shown) that is operable to determine a level of solvent in the solvent tank 19 and output a signal indicative thereof to controller 4. Solvent is consumed during operation of the printer 1 as it is added to the mixer tank 17 to adjust the viscosity of the ink in reservoir 18. Therefore the level of solvent in the solvent reservoir 20 in solvent tank 19 falls over time.

When the level of solvent in the solvent tank 19 falls below a lower threshold, the controller 4 is operable to control the ink supply system 2 so as to add more solvent to the solvent tank 19. Using suitable control signals, valves 48, 49 in the service module 6 are opened. Solvent is drawn from solvent cartridge 10 by electric flush pump 47 in the service module 6 and is supplied through line 62 to the solvent reservoir 20. The solvent discharges into the solvent reservoir 20, increasing the level.

When the level of solvent in the solvent tank 19 reaches an upper threshold the controller 4 is operable to stop the supply of solvent to solvent tank 19. To achieve this, flow to flush pump 47 is stopped and valves 48, 49 are closed.

Following such a process of topping up the level of solvent in solvent tank 19, the controller 4 sends a signal to data storage device 13 on solvent cartridge 10 indicative of the quantity of solvent that has been transferred from the cartridge 10 to the solvent tank 19. A quantity of solvent remaining in the solvent cartridge 10 may be stored on the data storage device 13 and may be updated in response to the signal from the controller 4.

Make-up solvent, provided from the solvent cartridge 10, is also used to flush the print head 3 at appropriate times in order to keep it clear of blockages, as now described. Ink is drawn from the mixer tank 17 and delivered under pressure to venturi pump 23 to create a suction pressure at the side port 42. Solvent is drawn from solvent cartridge 10 by electric flush pump 47 in the service module 6 and is supplied through a flush line 54 to the print head 3 via filter 55. Flow of solvent from the service module 6 to the print head 3 is controlled by first control valve 31.

A pressure relief valve 56 is connected across the inlet and outlet of the flush pump 47 and acts to relieve excess pressure to the suction side of the flush pump 56. For example, pressure relieve valve 56 may be arranged to maintain a desired pressure downstream of the flush pump 47, for example 2.5 bar.

The solvent flows through the first control valve 31 to the nozzle 32. After passing through the nozzle 32 and into the gutter 36 the solvent (along with dissolved ink from the print head 3) is drawn into the return 32 under suction pressure from the venturi pump 23. The solvent and ink discharge into the mixer tank 17.

As explained above, flow of ink and solvent into mixer tank 17 is achieved using venturi pump 24, which requires a minimum quantity of fluid in mixer tank 17. If there is insufficient fluid in the mixer tank 17 for operation of the venturi pump 24 (e.g. before a first use of the ink supply system 2), the flush pump 47 in service module 6 can be used to prime the mixer tank 17 by adding fluid to it.

To prime the mixer tank 17, an ink cartridge is engaged with the solvent cartridge connection 9. In order to add ink to the mixer tank 17, valves 48, 50 in the service module 6 are opened. Ink is drawn from an ink cartridge (in the solvent cartridge connection 9) by electric flush pump 47 in the service module 6 and is supplied through supply line 44 to the mixer tank 17 via side port 42. Once a sufficient quantity of ink has been added to the mixer tank 17, flush pump 47 is stopped and valves 48, 50 are closed.

In use, the atmosphere in the mixer tank 17 and the solvent tank 19 can become saturated with solvent. A condenser unit 57 is provided in an upper portion of the solvent tank 19. Condenser unit 57 may, for example, comprise a Peltier-type condenser.

A ventilation tube 58 is provided between the mixer tank 17 and the solvent tank 19 to allow air to flow therebetween. The ventilation tube 58 is arranged such that it links a space above the reservoir of ink 18 to a space above the reservoir of solvent 20. Solvent-laden vapour from the mixer tank 17 enters the solvent tank 19 via ventilation tube 58. The air from the mixer tank 17 is warmer than the air in the solvent tank (due to the action of the system pump 21), and therefore it rises to the top of the solvent tank via ventilation tube 58, where it enters the condenser unit 57.

Solvent condenses as the air contacts an active element within the condenser unit 57 and is cooled. The condensate (solvent) drains into the solvent reservoir 20. The dried air (from which the solvent has been removed) enters the common port of a three-way control valve 59. The flow of air through the system can be controlled using control valve 59, as now described.

The dried air from the condenser unit 57 may flow through exit line 60, via which it is vented to the air space inside the printer cabinet 16. This air flow path may be a default configuration for control valve 59.

Alternatively, the dried air from the condenser unit 57 may flow through line 61 which passes through the umbilical 15 to the print head 3. Line 61 terminates in the print head 3 at return line 37, near the gutter 36. Vacuum pressure draws the vented air along the return line 37 towards the second control valve 38 (along with any ink entering the gutter 36). Normal operation of venturi pump 23 draws the unused ink drops and vented air along the return line 37, through the umbilical 15 and back to side port 42. The unused ink and vented air are both discharged into the mixer tank 17.

When control valve 59 is used to direct the dried air from the condenser unit 57 through line 61, a 'closed' hydraulic loop is created. Any solvent vapour which is not recovered by the condenser unit 57 passes back to the mixer tank 17 via lines 61, 32 and loss of solvent from the inkjet printer 1 is therefore minimized. The system recirculates the same air continuously, which prevents (or at least minimizes) the influx of ambient air, which would otherwise enter via the gutter 36 (e.g. if the control valve 59 is venting the dried air from the condenser unit 57 to the air space inside the printer cabinet 16 via exit line 60). This preclusion of ambient air entering the system helps to prevent oxygen ingestion via the gutter 36, which promotes improved ink performance over the long term by reducing the probability of ink oxidation.

In some embodiments, the service module 6 may further a gas sensor 87, which may be operable to determine the presence or level of a gas (such as solvent vapour) within the cabinet 16. Gas sensors can become "poisoned" over time and therefore generally have a finite service lifetime, requiring replacement thereafter.

The service module 6 provides an interface between the inkjet printer 1 and each of ink and solvent cartridges 8, 10, allowing fluid to flow from each of the cartridges 8, 10 to the inkjet printer and providing an electrical link between the inkjet printer 1 and each of the cartridges 8, 10. Since the printer connection 11 provides for releasable engagement with an inkjet printer the service module 6 can be easily removed from the inkjet printer 1 for servicing or replacement. In general, such servicing or replacement will be performed at a different rate to that of replacement of the fluid cartridges 8, 10, or the rate of replacement of other replaceable components of the printer 1. This is advantageous because during operation of the inkjet printer 1, one or more of the plurality of conduits 46, valves 48, 49, 50, 51 and flush pump 47 may become blocked or damaged, or the gas sensor 87 may reach the end of its useful life.

Figure 3:
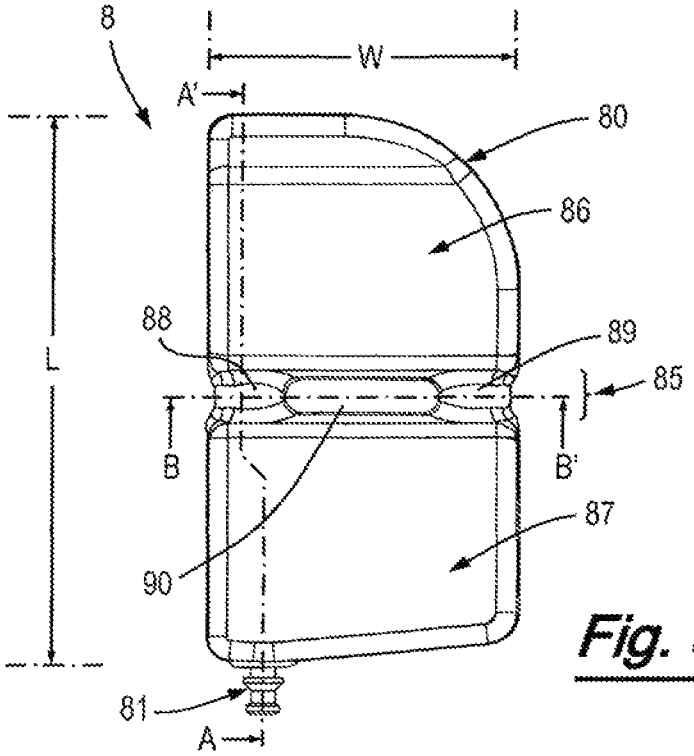
FIG. 3 is a front view of an ink cartridge for use with the printer of FIG. 1.
Figure 4:
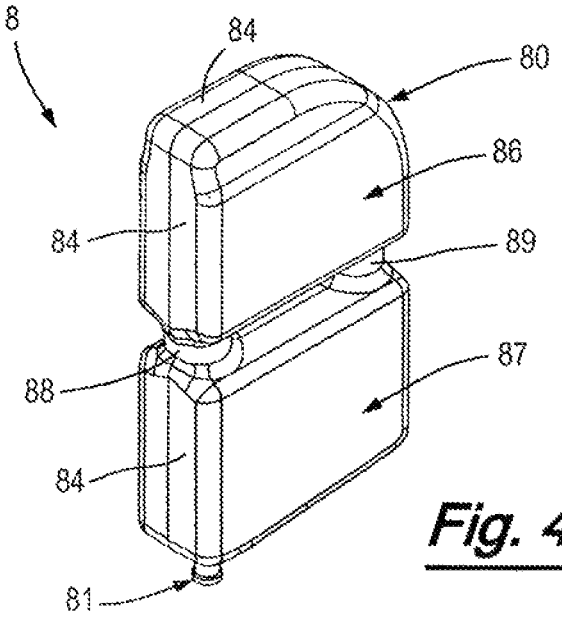
FIG. 4 is a perspective view of the ink cartridge of FIG. 3.
Figure 5:
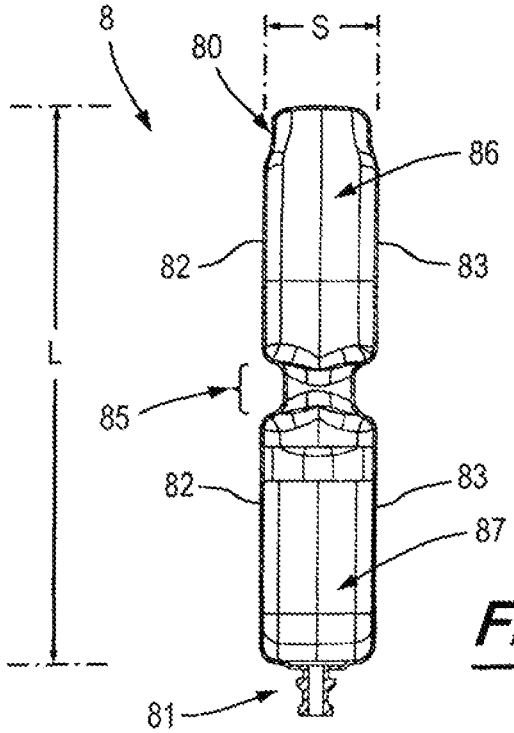
FIG. 5 is a cross-sectional side view of an ink cartridge of FIG. 3 cut along the line A-A'.

FIGS. 3 to 5 shows the ink cartridge 8 in more detail. It will be appreciated that the description of the ink cartridge 8 is also applicable to the solvent cartridge 10 which is substantially similar. The cartridge 8 has a volume of around 1000 millilitres and is formed from a thermoplastic material, suitably by blow moulding. The thermal plastic material may, for example, be high density polyethylene resin.

The cartridge 8 includes a reservoir 80 which encloses an internal space for storage of liquid, and an outlet 81 for dispensing the liquid from the reservoir 80 to the ink supply system 2. The outlet 81 may be provided with a fluid-tight seal or valve (not shown) which forms a fluid-tight engagement with the ink cartridge connection 7 of the ink supply system.

The reservoir 80 is generally box shaped. The internal space of the reservoir 80 is defined by a first face wall 82 (see FIG. 5), a second face wall 83 (see FIG. 5), and perimeter walls 84 (see FIG. 4). The first and second face walls 82, 83 are on opposite sides of the reservoir 80. The perimeter walls 84 connect the first and second boundaries of walls 82, 83. Suitably, the perimeter walls have a width defined by a separation between the first and second face walls 82, 83. An area of each face wall 82, 83 is greater than that of the perimeter walls 84 of the reservoir 80. The width of the perimeter walls 84 is less than the width W of the reservoir 80 (e.g. the width of the perimeter walls 84 may be less than 50% of the width W). The two face walls 82, 83 are substantially parallel to each other as illustrated in FIG. 5.

To control a separation S (see FIG. 5) between the two opposed face walls 82, 83, a reinforcing structure 85 is provided. As shown in FIGS. 3 and 5, the reinforcing structure 85 is located centrally along the length L of the reservoir, forming a waist portion of the reservoir 80. The reinforcing structure 85 preferably does not protrude beyond the outer boundaries of the reservoir 80 as defined by the face walls 82, 83 and the perimeter walls 84.

As shown in FIGS. 3, 4 and 5, the reinforcing structure 85 separates the internal space of the reservoir 80 into a first chamber 86 and a second chamber 87. As further shown in FIGS. 3 and 4, the reinforcing structure 85 provides fluid communication paths 88, 89 between the chambers 86, 87. The reinforcing structure 85 has an aperture 90 which passes through the reservoir 80.

The reinforcing structure 85 reinforces reservoir 80 so as to reduce bulging deformation of the reservoir 80 when filled with liquid. This allows the reservoir 80 to have a high capacity. In particular, the reinforcing structure 85 extends between the first and second face walls 82, 83 and thus prevents the separation S between the face walls 82, 83 from exceeding a predetermined upper limit. Therefore, the extent of distortion or deformation, such as bulging or ballooning, experienced by the reservoir 80 when filled with a high volume of liquid is reduced.

Figure 6:
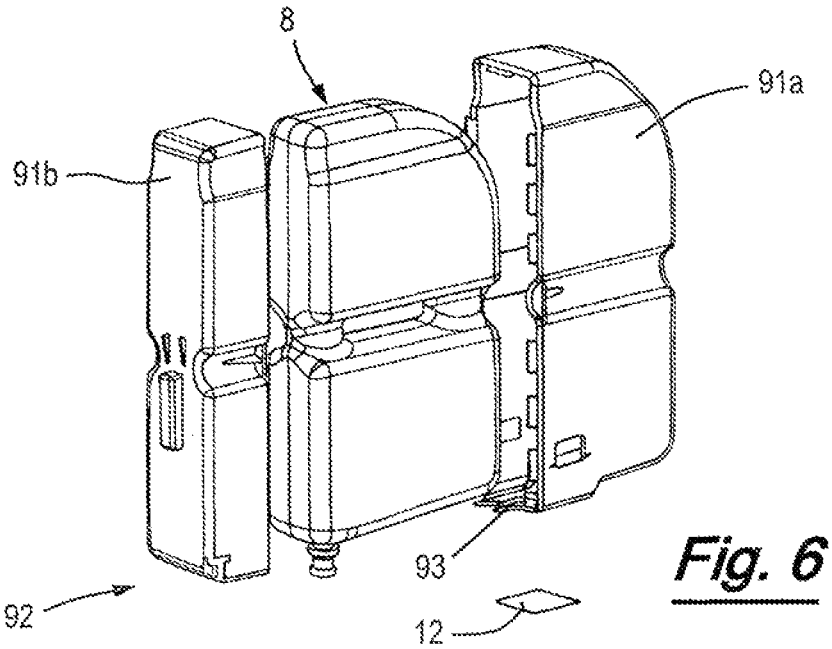
FIG. 6 is an exploded perspective view of an ink cartridge assembly for use with the printer of FIG. 1 and the cartridge of FIG. 3.

In use, the cartridge 8 may be enclosed within a shell casing 91 so as to form a cartridge assembly 92. As shown in FIG. 6 in combination with the cartridge 8, the shell casing 91 includes two parts 91*a*, 91*b* which may be releasably joined together by snap fits or other suitable means. The electronic data storage device 12 associated with the cartridge 8 may be mounted within a slot 93 provided by the shell casing 91. The shell casing 91 has a generally similar shape to that of the cartridge contained therein and may provide additional structural support to the cartridge 8, especially to the reinforcing structure 85. Therefore, the shell casing 91 may be helpful to limit the extent of distortion or deformation, such as bulging or ballooning, experienced by the reservoir 80.

Of course, it will be appreciated that the cartridge 8 may take other forms such as, for example, that described in European patent number 2,195,168.

Figure 7:
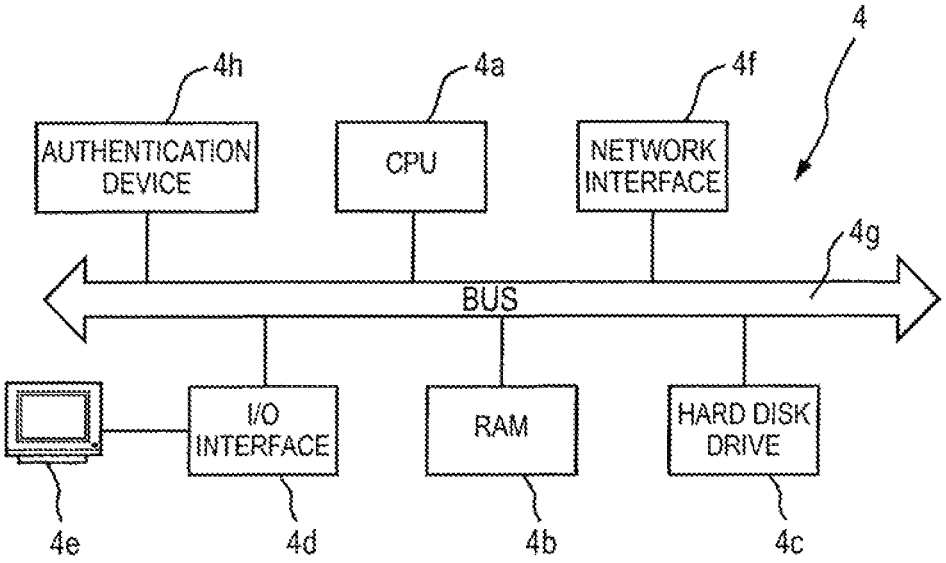
FIG. 7 is a schematic representation of a controller of the continuous ink jet printer of FIG. 1.

The configuration and operation of the controller 4 and the electronic data storage devices 12, 13, 14, 70, 71, 72 is now described in more detail. In use, the controller 4 communicates with each of the electronic storage devices 12, 13, 14, 70, 71, 72 so as to maintain correct operation of the printer 1. FIG. 7 shows the controller 4 in further detail. It can be seen that the controller 4 comprises a CPU 4*a* which is configured to read and execute instructions stored in a volatile memory 4*b* which takes the form of a random access memory. The volatile memory 4*b* stores instructions for execution by the CPU 4*a* and data used by those instructions. For example, in use, data relating to an image to be printed by the printer 1 (image data) or printer configuration or control data (printing data) may be stored in the volatile memory 4*b*.

The controller 4 further comprises non-volatile storage in the form of a hard disc drive 4*c*. Or course, other forms of non-volatile storage may be used. Image and/or printing data may be stored on the hard disc drive 4*c*. The controller 4 further comprises an I/O interface 4*d* to which are connected peripheral devices used in connection with the controller 4. More particularly, a display 4*e* is configured so as to display output from the controller 4. The display 4*e* may, for example, display a control interface for the printer 1. Input devices are also connected to the I/O interface 4*d*. Such input devices may, for example, include a touch screen interface which is associated with the display 4*e* allow user interaction with the controller 4. A network interface 4*f* allows the controller 4 to be connected to an appropriate computer network so as to receive and transmit data from and to other computing devices. The CPU 4*a*, volatile memory 4*b*, hard disc drive 4*c*, I/O interface 4*d*, and network interface 4*g*, are connected together by a bus 4*g*.

The controller 4 further comprises an authentication device 4*h*. The authentication device 4*h* is connected to the CPU 4*a* by the bus 4*g*. The authentication device 4*h* is a secure authentication and validation device, such as, for example an ATSHA204 CryptoAuthenication device manufactured by Atmel Corporation, United States. The authentication device 4*h* communicates with the CPU 4*a* via a serial data connection such as, for example, an $I^2C$ interface. It will be appreciated, however, that alternative secure authentication and validation devices may be used, and may communicate with the CPU 4*a* in a different way (e.g. via the I/O interface 4*d*).

The I/O interface 4*d* permits communications between the controller 4 and the various electronic storage devices 12, 13, 14, 70, 71, 72. Such communications may, for example, use an $I^2C$ interface.

Further, as described above, communication with the electronic data storage devices 12, 13 associated with the cartridges 8, 10 is via the service module 6. The ink and solvent cartridge connections 7, 9 thus each comprise an electrical contact arranged to contact a corresponding contact on the engaged ink or solvent cartridge 8, 10. Said corresponding contact on the cartridges 8, 10 allows information to be read from and/or written to data storage devices 12, 13 respectively via the printer connection 11 of the service module 6. Electrical connections (not shown) are also made between the controller 4 and each of the electronic storage devices 14, 70, 71, 72.

In use, the communications between the controller 4 and the various electronic storage devices 12, 13, 14, 70, 71, 72 is performed in such a way that the controller can authenticate the consumable components with which the electronic storage devices are associated. The electronic storage devices are each secure authentication and validation devices such as, for example, ATSHA204 CryptoAuthenication devices manufactured by Atmel Corporation, United States. It will be appreciated, however, that alternative secure authentication and validation devices may be used to provide authentication. The data stored on each of the electronic storage devices 12, 13, 14, 70, 71, 72 is now described in more detail.

The electronic storage device 12 (which is associated with the ink cartridge 8) stores data which may be useful so as to ensure and allow continued optimal operation of the printer 1. The data stored on the electronic storage device 12 may generally be referred to as "printing data". That is, the stored data generally relates to printing. The types of data stored within the electronic data storage device 12 are described in more detail below. Similarly, the electronic data storage device 13 associated with the solvent cartridge 10 stores data relating to the contained solvent (e.g. type and quantity of solvent). Further, the electronic data storage device 14 within the service module 6 may store data relating to the service module 6 (e.g. identification data).

In more detail, in an embodiment the electronic storage device 12 stores data relating to the cartridge 8 itself, such as, for example, data which allows the cartridge to be uniquely identified (e.g. alphanumeric data), data which specifies the volume of the cartridge, data relating to a relationship between the cartridge and other cartridges which may be packaged together, a best before date of the cartridge, and a production lot number of the cartridge. The electronic storage device 12 may also store data relating to the ink stored within the cartridge 8, such as, for example, data relating to the one or more of: the type of ink contained within the cartridge (e.g. whether the ink is dye or pigment based and/or food grade ink); how that ink should be used (e.g. whether any form of agitation is required prior to use); the quantity of ink stored within the cartridge 8; and properties of the ink stored within the cartridge 8. Such properties of the ink may include (but are not limited to) viscosity of the ink, density of the ink, conductivity of the ink. The electronic storage device 12 also stores data relating to other aspects of the printer 1 and their interaction with the ink and/or cartridge 8, such as, for example, data relating to the type of make-up solvent which is suitable for use with the ink, data relating to the temperature of the printhead, suitable nozzle sizes for use with the ink, and data relating to the type of printer with which the ink and/or cartridge is compatible.

The electronic storage device 12 may also store data relating to the recirculation of air within the printhead. For example, the electronic storage device 12 may store data indicative of a default level (e.g. an air flow rate, or a flow valve set point) for controlling the recirculation of air to the printhead. The electronic storage device 12 may also store a humidity threshold value which is indicative of a humidity level above which air recirculation to the printhead should be restricted for the type of ink contained within the cartridge. The electronic storage device 12 may also store a temperature threshold value which is indicative of a temperature level above which air recirculation to the printhead should be restricted for the type of ink contained within the cartridge.

It has been realised that by providing data relating to various properties of the ink contained within the cartridge 8 on the electronic storage device 12 associated with the cartridge 8 it is possible to provide enhanced printing performance. Such an approach avoids any risk associated with manual data entry of properties, such as, for example, the viscosity, density or conductivity of the ink. It will be appreciated that such a process of manual data entry is inherently unreliable, and is susceptible to user error.

Thus, by providing data relating to the ink density contained within an ink cartridge in a memory location of an electronic data storage device associated with that cartridge, it can be ensured that this data is reliably available to the printer in use, allowing optimal control of the printer based upon the accurate ink density data. Similarly, by providing data relating to the ink viscosity contained within an ink cartridge in a memory location of the electronic data storage device associated with that cartridge, it can be ensured that this data is reliably available to the printer in use, allowing optimal control of the printer based upon the accurate ink viscosity data. Furthermore, the data relating to the ink density may be used to generate data indicative of ink viscosity. As described above, the viscometer 52 may be used to generate a quantity indicative of the viscosity of the ink. However, it will be appreciated that data relating to ink density may also be used to generate data indicative of the viscosity of the ink. In particular, the data relating to ink density may be combined with data generated by the viscometer 52 to generate data indicative of the viscosity of the ink. Further, the data relating to the ink viscosity may comprise various coefficients which are indicative of a relationship between a measure of viscosity and temperature of the ink.

Further, by providing data relating to the ink conductivity contained within an ink cartridge in a memory location of the electronic data storage device associated with that cartridge, it can be ensured that this data is reliably available to the printer in use, allowing optimal control of the printer based upon the accurate ink conductivity data.

Moreover, it has also been realised that by providing data relating to the cartridge geometry on the electronic data storage device 12 associated with the cartridge 8 it is possible to provide an enhanced printing performance. Again, such an approach avoids the manual entry of data relating to the cartridge 8, such as, for example, the cartridge volume, which is inherently unreliable, and is susceptible to user error. It will be appreciated, therefore, that by providing data relating to the ink cartridge volume in a memory location of the electronic data storage device 12 associated with that cartridge 8, it can be ensured that this data is reliably available to the printer 1 in use, allowing optimal control of the printer 1 based upon the accurate cartridge volume data, as discussed in more detail below.

Further, it has also been realised that by providing data relating to the geometries of aspects of the printer 1 which are suitable for use with the ink contained in the cartridge 8, it is possible to provide an enhanced printing performance. Again, manual entry of data relating to the geometry, such as, for example, the printhead nozzle (or orifice) size, such a process is inherently unreliable, and is susceptible to user error. It will be appreciated, therefore, that by providing data relating to the printer geometry (e.g. nozzle size) in a memory location of the electronic data storage device 12 associated with that cartridge 8, it can be ensured that this data is reliably available to the printer 1 in use, allowing optimal control of the printer 1 based upon the accurate information relating to suitable nozzle sizes. For example, if an incorrect nozzle size is used, the nozzle may clog, resulting in downtime while cleaning is carried out, and adjustments needing to be made to the printer setup. As such, by providing such printer geometry data (reliably) to the printer 1, such downtime can be avoided or at least reduced.

The electronic storage device 12 also stores data relating to the ongoing use of the cartridge 8, such as, for example, the volume of ink remaining within the cartridge 8, and the number of times the cartridge 8 has been inserted into a printer (number of insertions). Data relating to the volume of ink remaining within the cartridge 8 may be updated based upon measurements made of how much fluid has been used during printing operations. For example, measurements of the volume of fluid which has been extracted from the cartridge 8 may be made by any convenient and well known technique. Such measurements may be used, in combination with data indicating the volume of the cartridge (which is stored in the electronic storage device 12), to accurately determine the remaining volume of ink within the cartridge 8. Furthermore, this data may be used to provide an accurate indication of the number of hours of operation which can be expected based upon the remaining volume of ink within the cartridge. In this way, the use of cartridge geometry data stored on the electronic storage device 12 can allow improved operation of the printer 1, for example, by allowing ink refilling to be scheduled for a convenient time. For example, if it is determined that there is insufficient ink remaining for the duration of a planned production run, the ink cartridge can be replaced before that particular production run is commenced, avoiding any interruption of planned operations.

The data items described above may be stored within a write-only memory region of the electronic data storage device 12 or a read-write memory region of the electronic data storage device 12. It will be appreciated that data items which are fixed at the time of manufacture of the cartridge 8 (e.g. cartridge identification, or ink type) are stored within the write-only memory region. On the other hand, data items which will change during use of the cartridge 8 (e.g. remaining ink volume, number of insertions of the cartridge) are stored within the read-write memory portion, having been initialised to an initial value during manufacture.

In a similar fashion, the electronic data storage device 13 stores data relating to the solvent cartridge 10, such as, for example, data which allows the cartridge 10 to be uniquely identified (e.g. alphanumeric data), data which specifies the volume of the cartridge 10, a best before date of the cartridge 10 and a production lot number of the cartridge 10. The electronic data storage device 13 may also store data relating to the solvent stored within the cartridge 10, such as, for example, the type of solvent stored within the cartridge 10. The electronic data storage device 13 also stores data relating to the ongoing use of the cartridge 10, such as, for example, the volume of solvent remaining within the cartridge 10, and the number of times the cartridge 10 has been inserted into a printer, which data may be stored in a read-write portion of the electronic data storage device 13.

When the ink supply system 2 is first used, data from the electronic data storage device 12 and/or the electronic data storage device 13 is read to ascertain a type of ink and/or solvent being used. Subsequently, when a new ink cartridge or solvent cartridge is used within the printer 1, a check may be made by the controller 4 of data stored on respective electronic data storage devices 12, 13 of the ink cartridge 8 and the solvent cartridge 10 to ensure compatibility. In this way, when the ink supply system 2 is used with a particular type of ink, the controller 4 ensures that the printer 1 is operable (i.e. ensures that ink is allowed to flow from the ink cartridge 8 and/or that solvent is allowed to flow from the solvent cartridge 10) only if data associated with the ink cartridge 8 and/or solvent cartridge 10 as stored on the electronic data storage devices 12, 13 indicates compatibility.

As described briefly above, the electronic data storage device 14 within the service module 6 may store identification data. Electronic data storage device 14 may also store other types of data, such as identification data relating to the type of ink and/or solvent that the service module 6 can be used with (or has previously been used with), data indicating technical information relating to the service module itself (e.g. service module type), data indicating the type of flush pump 47, data indicating the type of valves 48, 49, 50, 51, data relating to a characteristic of the gas sensor 87 (e.g. calibration or offset data), a model number of the service module 6 or inkjet printer 1, a serial number, a manufacture date, an expiration date, a date first used in service, number of hours the service module 6 has been used in the inkjet printer 1, service life, and the like.

The electronic data storage device 14 may also include a writable data portion. The inkjet printer 1 may write to the electronic data storage device 14 to indicate that the service module 6 has reached the end of its service life, so that the service module can no longer be used in the inkjet printer 1 or any other printer.

In a similar fashion to the electronic storage devices 12, 13, 14, the electronic storage device 70 associated with the filter module 25 also stores data associated with the filter module 25. For example, in an embodiment the electronic storage device 70 stores data relating to the filter manufacture date and rating (in terms of particle size). The electronic storage device 70 also stores data relating to the use of the filter, such as, for example, the number of insertions, and ink type with which the filter has been used. The inkjet printer 1 may write to the electronic data storage device 70 to indicate that the filter module 25 has reached the end of its service life, so that the filter module 25 can no longer be used in the inkjet printer 1 or any other printer.

The electronic storage device 71 associated with the print head 3 stores data relating to the print head 3. For example, in an embodiment the electronic storage device 71 stores data relating to the printhead type and geometry (e.g. print head build up sensor presence, printhead nozzle size, printhead deflection plate type, printhead deflection plate size, printhead deflection plate gap, last chance filter details (if present), printhead drop generation frequency, printhead manufacture date. The electronic storage device 71 also stores data relating to the use of the printhead 3, such as, for example, the number of insertions, and the accumulated total number of drops deflected by the printhead in use. The inkjet printer 1 may write to the electronic data storage device 71 to indicate that the printhead 3 has reached the end of its service life, so that the printhead 3 can no longer be used in the inkjet printer 1 or any other printer.

The electronic storage device 72 associated with the ink storage system 5 stores data relating to ink storage system 5 itself, such as, for example, data relating to the manufacture and assembly of the various components of the ink storage system 5 (e.g. ink management board). More generally, the electronic storage device 72 may store data relating to the ink supply system 2 and printer 1 as a whole. For example, in an embodiment the electronic storage device 72 stores data relating to the use of the ink storage system 5, such as, for example, the number of hours for which the ink storage system 5 has been used, data relating to the number of hours for which the ink pump 21 has been used.

The electronic storage device 72 may also, for example, store data relating to the operation of the ink cartridge 8, the solvent cartridge 10, the service module 6, the filter module 25, and the printhead 3. In an embodiment the electronic storage device 72 stores data which allows the ink and/or solvent cartridges to be uniquely identified (e.g. alphanumeric data), data which specifies the volume of the ink and/or solvent cartridges, data relating to a relationship between the ink cartridge and other ink cartridges which may be packaged together, a best before date of the ink cartridge, and a production lot number of the cartridge. The electronic storage device 72 may also store data relating to the ink stored within the cartridge 8, such as, for example, data relating to the one or more of: the type of ink contained within the cartridge (e.g. whether the ink is dye or pigment based and/or food grade ink); how that ink should be used (e.g. whether any form of agitation is required prior to use); the quantity of ink stored within the cartridge 8; and properties of the ink stored within the cartridge 8. Such properties of the ink may include (but are not limited to) viscosity of the ink, density of the ink, conductivity of the ink. The electronic storage device 72 also stores data relating to other aspects of the printer 1 and their interaction with the ink and/or cartridge 8, such as, for example, data relating to the type of make-up solvent which is suitable for use with the ink, data relating to the temperature of the printhead and suitable nozzle sizes for use with the ink.

It will be appreciated that data stored by one of the above described electronic storage devices 12, 13, 14, 70, 71, 72 may be a duplicate of data stored on another one of the electronic storage devices. For example, where the electronic storage device 72 stores data relating to the ink cartridge 8, this data may have been copied from the relevant storage location of the electronic storage device 12.

In general, the electronic data storage devices 12, 13, 14, 70, 71, 72 may include security properties so that only suitable or recognized components (e.g. consumable components) can be used with the inkjet printer 1, and/or so that only suitable or recognised printers or devices have full access to data stored within the be used with the electronic data storage devices 12, 13, 14, 70, 71, 72.

It will be understood that where components are expected to have a service life which is less than that of the printer 1, or where they may be exchanged for any reason, the electronic data storage devices which are associated with those components can allow automatic configuration changes to be made as required to ensure continued operation of the printer 1. In particular, where a parameter associated with a component may differ between a particular component and a replacement for that particular component (e.g. a cartridge capacity, remaining ink volume, a filter lifetime, or filter usage data) data relating to the parameter may be used to adjust the configuration of the printer in some way (e.g. to record usage and provide an appropriate alert). As such, by providing the data to the printer 1 as described above, it is possible to reduce the reliance of manual data entry (which, as set out above, is inherently unreliable) and to automatically reconfigure a printer 1 as necessary.

In an embodiment, compatibility can be checked between components, for example between a nozzle of a newly installed printhead and ink contained within an ink cartridge. It will be appreciated that such compatibility is necessary for optimal operation of the printer, and that by controlling the printer so as to prevent operation with incompatible components damage to the printer (or components thereof) can be prevented.

Moreover, by providing electronic data storage devices which are associated with a plurality of ink supply system components (especially where those components may be provided in different varieties), it will be appreciated that the possibilities for automatic configuration are increased. The use of automatic configuration enables in this way allows components to be provided in different varieties without significantly increasing the risk of printer failure. That is, rather than providing a single variety of a component which is suitable for all printers, and all uses, it may be desirable to provide a variety of components, different ones of which may be particularly appropriate for a particular printer based upon properties such as, for example, expected rate of use, environmental conditions, maintenance requirements, and so on. However, where no automatic configuration is possible, each deviation from a standard component may result in a failure where a relevant piece of data is manually input to the printer. As such, by providing electronic data storage devices which are associated with each of several printer components, reliable operation of the printer can be improved.

In some embodiments, data stored within the electronic device 71 associated with the printhead 3 may provide information relating to the type of print nozzle within the printhead 3 and/or the type of deflection plate within the printhead 3. Such information may be used by the controller to ensure that the printer 1 is operated correctly in accordance with those sub-components (e.g. by providing appropriate charging and stimulation signals and/or ink pressure). For example, the modulation signals applied to the nozzle may, for some nozzle types, have a fixed frequency, and, for other nozzle type, have a variable frequency. An appropriate nozzle modulation algorithm for generating the modulation signals applied to the nozzle can therefore be selected based upon the data relating to the type of print nozzle.

In this way, the printhead 3 can be replaced with an alternative printhead having a different type or configuration and any risk of incorrect operation due to incorrect configuration settings can be minimised.

In some embodiments, data indicative of a type of ink contained within the ink cartridge 8 obtained from the electronic storage device 12 can be used in combination with sensor data received by the controller 4 from one or more sensors contained within the printer 1, to optimise or improve printer control.

For example, ink type data may be combined with temperature data and/or humidity data in order to maintain correct operation. For example, certain types of ink are more hydroscopic than others, so the printer may be arranged to monitor the temperature and/or humidity. Depending upon the temperature and/or humidity level detected, the recirculation of air to the printhead may be controlled as appropriate. For example, if the temperature and/or humidity levels exceed respective threshold levels (which threshold levels may be stored on the electronic storage device 12) the intake of new air into the system may be reduced. In this way, the control of air recirculation may be based upon a combination of monitored temperature, monitored humidity levels and data associated with the ink contained within the cartridge.

Figure 8:
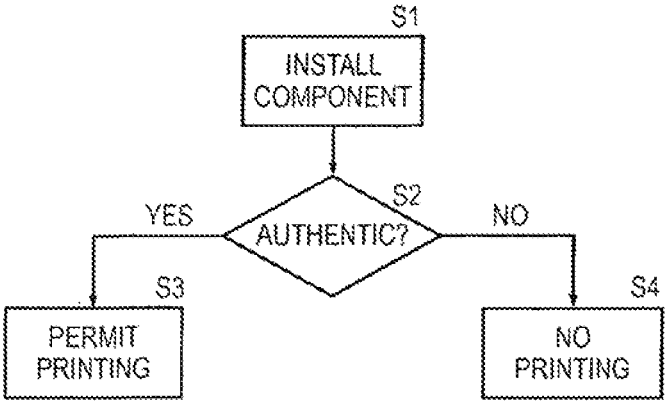
FIG. 8 is a flow chart representing operations performed by the continuous ink jet printer of FIG. 1.

An authentication process, which is performed by the printer 1 so as to authenticate the consumable component (e.g. ink cartridge 8, with electronic storage device 12), and which makes use of the security features described briefly above, is now described in detail with reference to FIG. 8. At step S1 the ink cartridge 8 is physically connected to the connection 7 of the service module 6. At step S2, the controller 4 performs an authentication process, during which a decision is made as to whether the ink cartridge 8 is considered to be authentic. If the ink cartridge 8 is considered to be authentic, then processing passes to step S3, where normal printing operations can be carried out. If the ink cartridge 8 is not considered to be authentic, then processing passes to step S4, where printing operations are prevented, and the user is informed that the installed ink cartridge 8 is not an authentic ink cartridge. The process begins again at step S1 if a new consumable component (e.g. cartridge, filter module, printhead, service module) is detected.

The authentication process carried out at step S2 is arranged to ensure that only authentic consumable components are permitted to be used with the printer 1. The authentication process makes use of a Message Authentication Code (MAC) which is generated by the electronic storage device in question (e.g. electronic storage device 12) and which MAC is compared to a MAC which is generated by the authentication device **4*h* associated with the controller 4**. If the two MACs agree, then authentication is complete, if not, then the consumable component is not considered to be authentic.

The MAC itself can be generated in a number of ways, and can be in some way based upon a user defined secret, a static internal secret key or a challenge which is provided by the authentication device **4*h*. In addition, each electronic storage device has a unique serial number (some bits of which can be configured to relate to a particular manufacturer). The MAC is generated by providing data to a Secure Hash Algorithm (SHA-256) engine contained within the authentication device 4*h*** or electronic storage device. The generated MAC comprises a 256 bit code. Authentication maybe based upon various challenge techniques, such as, for example, Fixed Challenge Authentication, Unique Challenge Authentication, Random Challenge Authentication or Diversified Key Authentication.

Figure 9:
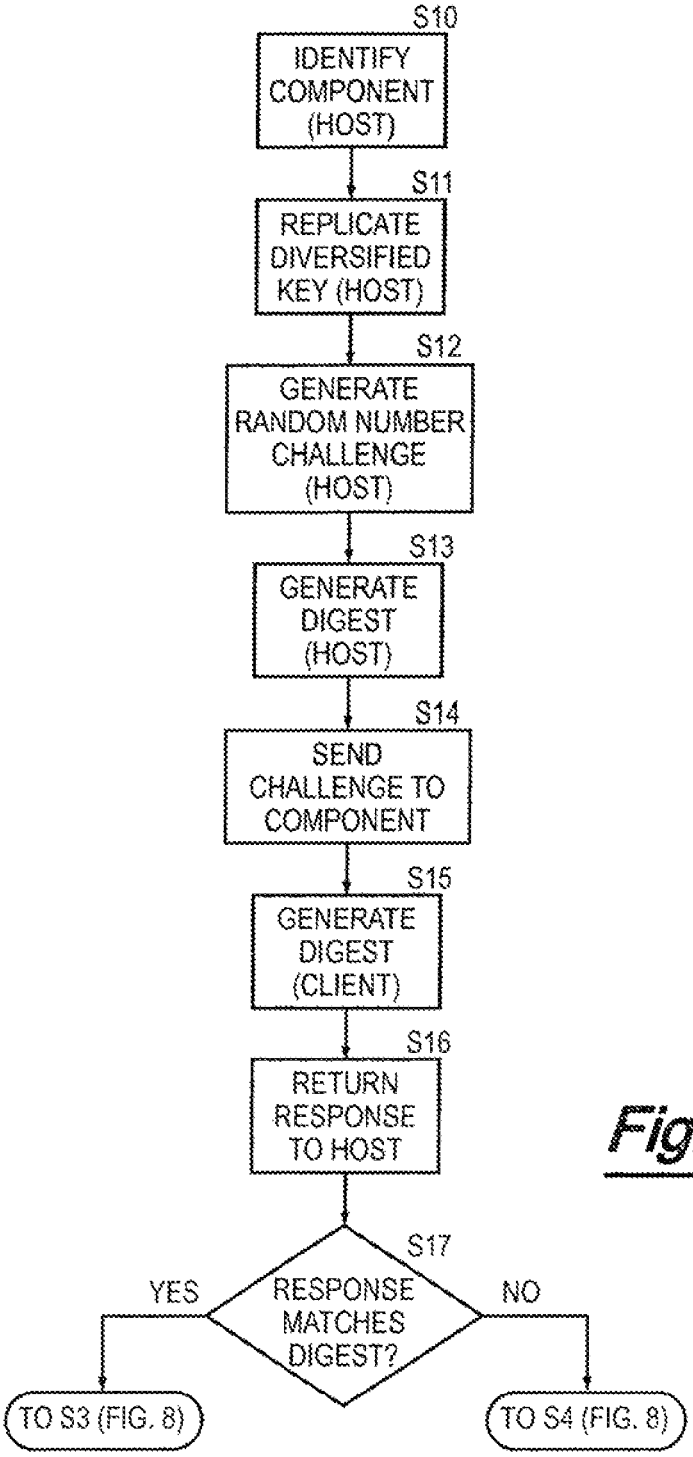
FIG. 9 is a flow chart representing a method performed by the controller of FIG. 3.

In an embodiment Diversified Key Authentication is used. Processing steps carried out so as to provide such authentication are now described with reference to FIG. 9, and take place during step S2 as described above with reference to FIG. 8. This processing begins at step S10, where the controller 1 identifies the consumable component (e.g. by reading a serial number stored within a memory location of the electronic storage device 12). Processing then passes to step S11, where a cryptographic calculation is performed within the authentication device **4*h* based upon the obtained serial number, and a root key, which is securely stored within the authentication device 4*h*. The cryptographic calculation replicates a diversified key which is stored within the electronic storage device 12**.

Processing then passes to step S12, where the authentication device **4*h* generates a random number challenge. This challenge is passed, along with the diversified key generated at step S11, to a SHA-256 engine within the authentication device 4*h*, which generates a response (or digest) at processing step S13. Processing then proceeds to step S14 where the random number challenge is passed to the electronic storage device 12 within the consumable component. At processing step S15, a SHA-256 engine within the electronic storage device 12 receives the random number challenge, and also receives the version of the diversified key which is stored within the electronic storage device 12, and generates a response (or digest). At processing step S16 this generated response is returned to the authentication device 4*h*, and then processing passes to step S17, where the authentication device 4*h* performs a comparison to determine whether the response generated by the electronic storage device 12 matches the response (digest) generated within the authentication device 4*h*. If the response matches, then authentication has been successful and processing returns to step S3 of FIG. 8. If, on the other hand, the response does not match, then authentication has not been successful and processing returns to step S4 of FIG. 8**.

It will, of course, be appreciated that the authentication process described above is one way in which authentication may be performed, and that alternative techniques may be used. Further, the authentication process may be selected based upon the type of secure authentication and validation device selected, or vice versa.

Once authentication has been (successfully) performed, further data items can be retrieved from the storage locations within the authenticated electronic storage device 12, and used to control the operations of the printer 1 as described in more detail above.

A similar authentication process may be carried out by the printer 1 to authenticate each consumable component which is installed. Authentication may be carried out thereafter at any convenient interval (e.g. upon start-up or when a configuration is changed).

It will be appreciated that some data items stored within the various electronic storage devices 12, 13, 14, 70, 71, 72 are not expected to change after manufacture, and, as such, do not need to be edited. However, as described above some data items (e.g. data relating to the ongoing use of a cartridge, such as, for example, the volume of solvent remaining within the cartridge) may change during use, and thus may be stored in a read-write portion of the electronic data storage device 12.

However, rather than permitting free read-write access to such data items as may change during operation, the controller 4 and electronic data storage device 12 communicate in such a way as to ensure that only an authorised device (e.g. printer, or authorised manufacturing device) has write access to those data items. It has been realised that if consumable components which are required to be used with the printer 1 (e.g. cartridges 8, 10, filter module 25, service module 6) are not protected in this way, it may be possible to for data stored on an electronic data storage device of an consumable components to be modified such that it does not properly reflect the contents or condition of that component, and for those components to be used inappropriately with a printer, reducing the quality of printing, and possibly causing damage to the printer. As such, data writes to predetermined storage regions within the electronic data storage device 12 are permitted only when the electronic data storage device 12 is connected to an authorised printer 1 (or another authorised device—such as during manufacture).

It will be understood that a similar process may also be used to protect predetermined storage regions within the electronic data storage devices 13, 14, 70, 71 associated with the various other consumable devices.

It will also be understood that if a consumable component has reached the end of its service life it should be replaced. For example, the filter module 25 may have a lifetime of in hours (e.g. around 5000 hours). Any use beyond this duration may result in an increased risk of the filter becoming clogged, and failing to provide the correct ink flow to the printhead. Similarly, a service module 6 may, for example, have a lifetime in hours used (e.g. around 12,000 hours). Use beyond this time may increase the risk of ink blockages, pump failures, or other failure modes.

Ink and solvent cartridges may be considered to be at the end of their service life when the fluid contained therein has been consumed. It will, of course, be understood that refilling of cartridges may result in an incompatible ink (or solvent) being used with the printer 1, and associated problems (e.g. contamination of fluid lines or other consumable components, and consequential degraded printing). As such, by preventing the writing to particular data storage regions by a non-authorised device, it is possible to prevent any such problems from occurring due to the use of incompatible inks or solvents.

Thus, the printer 1 is also configured to become inoperative if a data item stored within an electronic data storage device associated with a consumable component indicates that the consumable component has reached the end of its service life. If it was possible to over-write the relevant data items in the electronic data storage device to indicate that further use of the consumable component was possible, a consumable component may inadvertently be used when it is in a condition which may lead to damage being done to other system components. As such, by providing data storage regions in the electronic storage device which can be written to only by an authorised device (e.g. the printer 1), it is possible to prevent such incorrect operation, and thus to reduce the risk that damage is caused to the printer 1 (or its constituent components/other consumable components), and to provide more reliable printing performance.

In some embodiments information stored on any one of the electronic data storage devices 12, 13, 14, 70, 71 may be stored in encrypted form. This may prevent and access (even read access) to the data by an unauthorised device.

Reference has been made in the preceding description to the controller 4, which is described with reference to FIG. 7. Various functions have been attributed to the controller 4. It will be appreciated that the controller 4 can be implemented in any convenient way including as an application specific integrated circuit (ASIC), field programmable gate array (FPGA) or a microprocessor connected to a memory storing processor readable instructions, the instructions being arranged to control the printer and the microprocessor being arranged to read and execute the instructions stored in the memory. Furthermore, it will be appreciated that in some embodiments the controller 4 may be provided by a plurality of controller devices each of which is charged with carrying out some of the control functions attributed to the controller 4.

While specific embodiments of the invention have been described above, it will be appreciated that the invention may be practiced otherwise than as described and that that the described embodiments are for all purposes exemplary, not limiting. Various modifications can be made to the described embodiments without departing from the spirit and scope of the present invention.

The invention claimed is:

1. An ink jet printer comprising a controller, the printer being configured to receive:

a removable module comprising a first electronic data storage device storing data related to an operation of the removable module, and at least one component selected from the group consisting of: a filter, a fluid damper, a valve, a pump, a gas sensor, a drop generator, a piezoelectric oscillator, a charge electrode, a deflection electrode and a gutter; and at least one cartridge in flow communication with the removable module, said at least one cartridge comprising second electronic data storage device;

wherein the controller is configured to:

receive data from said first electronic data storage device; and control an operation of the printer based upon said received data.

2. An ink jet printer according to claim 1, wherein the removable module comprises a filter module, and the at least one component comprises a filter and/or a fluid damper.

3. An ink jet printer according to claim 1, wherein the removable module comprises a service module, and the at least one component comprises one or more of a valve, a pump, and a gas sensor.

4. An ink jet printer according to claim 1, wherein the removable module comprises a print module, and the at least one component comprises one or more of a drop generator, a piezoelectric oscillator, a charge electrode, a deflection electrode and a gutter.

5. An ink jet printer according to claim 1, wherein the data related to an operation of the removable module comprises data relating to a condition of the removable module and/or a component of the removable module.

6. An ink jet printer according to claim 5, wherein the data relating to a condition of the removable module and/or a component of the removable module comprises data indicative a number of hours for which the removable module and/or a component of the removable module has been used.

7. An ink jet printer according to claim 5, wherein the data relating to a condition of the removable module and/or a component of the removable module comprises data indicating that the removable module and/or a component of the removable module has exceeded a predetermined usage limit.

8. An ink jet printer according to claim 1, configured to receive a plurality of removable modules, the plurality of removable modules each comprising a respective first electronic data storage device storing data related to an operation of the respective one of the plurality of removable modules, each of the plurality of removable modules further comprising a component selected from the group consisting of: a filter, a fluid damper, a valve, a pump, a gas sensor, a drop generator, a piezoelectric oscillator, a charge electrode, a deflection electrode and a gutter.

9. An ink jet printer according to claim 8, wherein the controller is configured to:

receive data from each of said first electronic data storage devices; and control an operation of the printer based upon said received data.

10. An ink jet printer according to claim 1, wherein controlling an operation of the printer based upon said received data comprises configuring an operation of the printer based upon said received data.

11. An ink jet printer according to any one of claim 1, wherein the controller is configured to:

receive data from the second electronic data storage device of the at least one cartridge and the first electronic data storage device of the removable module or one of the removable modules; and control an operation of the printer based upon said received data.

12. An ink jet printer according to claim 1, wherein:

the first electronic data storage device of the removable module or one of the removable modules, and/or the cartridge, is configured to permit data write access to a predetermined data storage portion only by an authorised device; and said first electronic data storage device is configured to determine whether the controller is an authorised device and to permit data write access to the predetermined data storage address by the controller if but only if the controller is an authorised device.

13. An ink jet printer according to claim 1, wherein:

the received data from said first electronic data storage device storing data related to an operation of the removable module comprises data indicative of a property of an ink jet print nozzle associated with a printhead of said printer; and controlling an operation of the printer based upon said received data comprises generating a modulation signal for said ink jet print nozzle based upon said received data.

14. An ink jet printer according to claim 1, wherein the controller is configured to:

receive data from said second electronic data storage device associated with the at least one cartridge; and control an operation of the printer based upon said received data.

15. An ink jet printer according to claim 14, wherein controlling an operation of the printer based upon said received data further comprises:

receiving sensor data; and controlling said operation of the printer based upon said sensor data.

16. An ink jet printer according to claim 15, wherein the sensor data comprises temperature and/or humidity sensor data.

17. A method of operating an ink jet printer, comprising:

receiving a removable module comprising a first electronic data storage device storing data related to an operation of the removable module, and at least one component selected from the group consisting of: a filter, a fluid damper, a valve, a pump, a gas sensor, a drop generator, a piezoelectric oscillator, a charge electrode, a deflection electrode and a gutter;

receiving at least one cartridge that is in flow communication with the removable module, said at least one cartridge comprising a second electronic data storage device;

receiving, by a controller of the ink jet printer, data from said first electronic data storage device of the removable module; and controlling an operation of the printer based upon said received data.

18. An ink jet printer comprising:

a controller;

a removable module comprising a first electronic data storage device storing data related to an operation of the removable module, and at least one component selected from the group consisting of: a filter, a fluid damper, a valve, a pump, a gas sensor, a drop generator, a piezoelectric oscillator, a charge electrode, a deflection electrode and a gutter; and at least one cartridge in flow communication with the removable module, said at least one cartridge comprising a second electronic data storage device;

wherein the controller is configured to:

receive data from said first electronic data storage device; and control an operation of the printer based upon said received data.

* * * * *